United States Patent [19]

Blanchard et al.

[11] 4,294,557

[45] Oct. 13, 1981

[54] SHIELD FOR TYPEWRITER KEYBOARD AND CYLINDER

[76] Inventors: Carroll H. Blanchard, 26 S. Royal Dr., Albany, N.Y. 12205; Robert P. Marcelonis, 170 Ottawa St., Lake George, N.Y. 12845

[21] Appl. No.: 107,543

[22] Filed: Dec. 27, 1979

[51] Int. Cl.[3] ..... B41J 29/12

[52] U.S. Cl. ..... 400/714; 400/679; 248/459; 434/227

[58] Field of Search ..... 400/713, 714, 679; 35/5, 6; 248/174, 442.2, 459; 434/227

[56] References Cited

U.S. PATENT DOCUMENTS

| | | | |
|---|---|---|---|
| 772,130 | 10/1904 | Chandler | 400/714 |
| 1,257,506 | 2/1918 | McGill | 400/713 |
| 1,533,585 | 4/1925 | Corcoran | 400/714 |
| 1,650,866 | 11/1927 | Fimess | 400/713 |
| 2,472,166 | 6/1949 | Mathewson | 248/459 |
| 3,762,528 | 10/1973 | Garman | 400/714 |
| 3,971,140 | 7/1976 | Martinez | 35/5 |
| 4,105,182 | 8/1978 | Jacobson | 248/459 |

FOREIGN PATENT DOCUMENTS

| | | | |
|---|---|---|---|
| 938672 | 2/1956 | Fed. Rep. of Germany | 400/714 |
| 1460463 | 10/1966 | France | 400/714 |

OTHER PUBLICATIONS

Laluk, "Security Device for Typewriter" Xerox Disclosure Bulletin vol. 3, No. 5 p. 305 Sep./Oct. 1978.

*Primary Examiner*—William Pieprz
*Attorney, Agent, or Firm*—Heslin & Watts

[57] ABSTRACT

A portable shield intended to block the student typist's view of the keyboard and cylinder is made of cardboard having creases for folding at convenient locations. One portion of the shield screens the keyboard while another portion screens the cylinder. A relatively long extension member is attached to one side of the keyboard portion, extends downwardly along one side of the typewriter and is folded to pass under the feet of the typewriter in order to hold the device in place. The keyboard shield portion is also flexibly attached to the top of the typewriter so that the operator can raise the keyboard portion simply by raising his wrists against the bottom of it. This will enable him to check the position of his hands on the keyboard.

4 Claims, 3 Drawing Figures

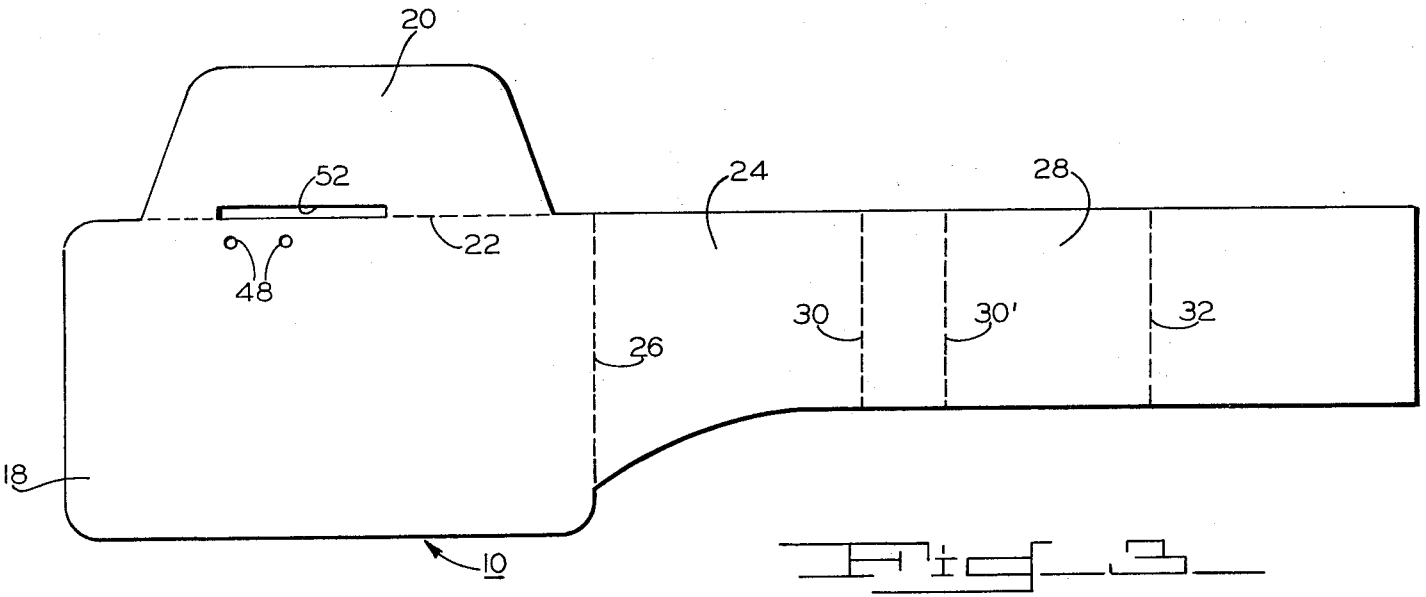
20
52
48
22
24
28
26
30
30'
32
10
18

SHIELD FOR TYPEWRITER KEYBOARD AND CYLINDER

BACKGROUND OF THE INVENTION

This invention relates to shields of the type used by students learning to type. More particularly, it relates to shields of the kind which are effective to obscure the keyboard and the cylinder of the typewriter from the student's view while he is typing.

It has become well-known in the methodology for teaching typing to train the student to operate the typewriter without looking at the keys or the copy as it is typed. Rather, the student is taught to look instead at the reference material from which he is typing and, in any event, not to depend upon a visual association of his hands and fingers with the keyboard. In general, this technique of typing is referred to as the "touch typing" system.

Prior to the introduction of the student to touch typing, it is generally believed to be desirable to permit him to familiarize himself with the typewriter, the operation of its keyboard and other parts through visual association. In other words, he is initially permitted to type while looking at the keys and/or copy as it is being typed. This introductory experience, however, is usually of relatively short duration. It then becomes necessary to break the student from the habit of looking at the keys and copy. One way of doing this is simply to instruct the student to look at the source material being transcribed and not to look in the direction of the typewriter. This method has produced less than satisfactory results, however, and many students taught in this way never truly learn touch typing. Consequently, a number of screening devices have been used to provide a visual barrier between the student and the keyboard and the cylinder of the typewriter.

An example of such a device is shown in U.S. Pat. No. 3,762,528. The device in question consists of a pair of hingedly connected and vertically adjustable screens supported by a bar which passes vertically in front of the keyboard. The student places his hands on either side of the bar and the screens provide a visual barrier between the student and the typewriter. Other devices have been made for direct and relatively permanent attachment to the typewriter itself. Some devices have been made with base plates to be inserted under the feet of the typewriter for stability.

All of the typewriter shields known to the applicants are relatively bulky and unportable. Generally, they are not compact enough for everyday transporting by the student between his school and home. Moreover, since they are fabricated from relatively expensive materials, often metal, it tends to be too costly to provide each student with his own personal shield. A related disadvantage of the existing shields known to the applicants is that they are generally expensive to repair when the need arises.

There are, in addition, certain shortcomings of existing typewriter shields which are related more directly to their effectiveness as a teaching tool. Some, for example, involve the use of structures relatively close to the student's face and they therefore tend to restrict his peripheral vision. The applicants have found that it is desirable to maintain the student's peripheral vision at a maximum in order to enhance his learning of a motor skill such as typewriting. Still another shortcoming noted generally with existing shields is that many of them, being constructed of metal to produce the degree of strength their design requires, produce vibration noises as the typewriter is operated. This proves to be a distraction to the student and impedes the learning process.

All of the foregoing shortcomings and disadvantages are overcome by the present invention. The present invention has for one of its objects the provision of a simple, easily assembled and economical shield. It is a further object of this invention that the shield be portable so that it can be easily carried with the student's other materials between his school and home. Still another object of this invention is to produce a shield which will be silent in operation so as to avoid any distracting noise while the student is learning.

Still another object of the present invention is to produce a shield which is relatively compact during use with the typewriter so that it does not reduce the student's peripheral vision.

Finally, it is a further object of this invention to produce a shield which can be easily repaired in the event that it should become damaged.

SHORT STATEMENT OF THE INVENTION

The various advantages recited above are provided in a shield fabricated of a relatively stiff, but foldable lightweight material and having one screen for covering the keyboard and a second screen for covering the cylinder, the two screens being hingedly connected to one another. The keyboard screen is maintained in a horizontal position over the keyboard, in part, by a vertical extension member hingedly connected on one side and a horizontal extension member which is, in turn, hingedly connected to the vertical extension member. The horizontal extension member is placed under the front feet of the typewriter for stability. Means are also provided for connecting the keyboard screen to the typewriter casing for stability.

Also briefly described, the invention consists of a keyboard screen with a cylinder screen hingedly attached, a relatively elongated extension member being hingedly attached to the typewriter screen on one side so that it can be foldably wrapped around one end of the typewriter and placed under the front feet thereof, together with means for securing the keyboard screen to the top of the typewriter.

BRIEF DESCRIPTION OF THE DRAWINGS

FIG. 3 is a top plan view of the invention in unfolded form with the clip assembly removed, showing the relationship between the keyboard and cylinder screen portions and the extension member portions.

Referring now to FIG. 1, the typewriter shield 10 is shown in its operative relationship to a typewriter 12 (shown in phantom). The keyboard 14 and cylinder 16 are shown in their customary positions. Shield 10 is shown as having a keyboard screen portion 18 and a cylinder screen portion 20, the two parts being hingedly connected along crease 22. A vertical extension member 24 is hingedly connected at one side of keyboard shield 18 along crease 26. A horizontal extension member 28 is, in turn, hingedly connected to the other end of vertical extension member 24 along crease 30 and rests under the front feet (not shown) of typewriter 12. As shown in FIG. 3, alternate crease 30' is provided to accommodate typewriters requiring greater vertical clearance. Also, a packing crease 32 permits the shield 10 to be compactly folded into a bundle having the overall dimensions of keyboard screen 18. This is accomplished by folding extension member 24 at crease 26 under keyboard shield 18, without folding at creases 30 or 30', and then folding extension member 28 back along crease 32 so that it will not overhang the left edge of keyboard shield 18. Cylinder shield 20 may be folded toward the viewer in FIG. 3 so as to lay on top of keyboard shield 18.

Shield 10 is secured to the top of the typewriter by means of a snap clip assembly 34 as shown in FIG. 2. Assembly 34 includes a clip 36 which may be made of spring steel or any other suitable material. A snap 38 is connected to clip 36 by means of flexible straps 40 and 42 which are connected by rivet 44 to base plate 46 of snap 36. A pair of holes 48 are made in keyboard shield 18 near crease 22 to accommodate post 50 of the snap 38. A slot 52 is provided in cylinder shield 20 along crease 22 to permit strap 40 to pass therethrough. As shown in FIGS. 1 and 2, clip 36 is adapted to engage typewriter casing 54 at the edge of the well found on many typewriters near the cylinder.

The shield 10 is preferably constructed of a relatively thin cardboard material having sufficient strength and stiffness. This material should be foldable and is preferably creased at the places described above and as shown in FIG. 3 for convenient use. A material other than cardboard may be used so long as it provides a reasonable degree of stiffness and foldability.

Figure 1:
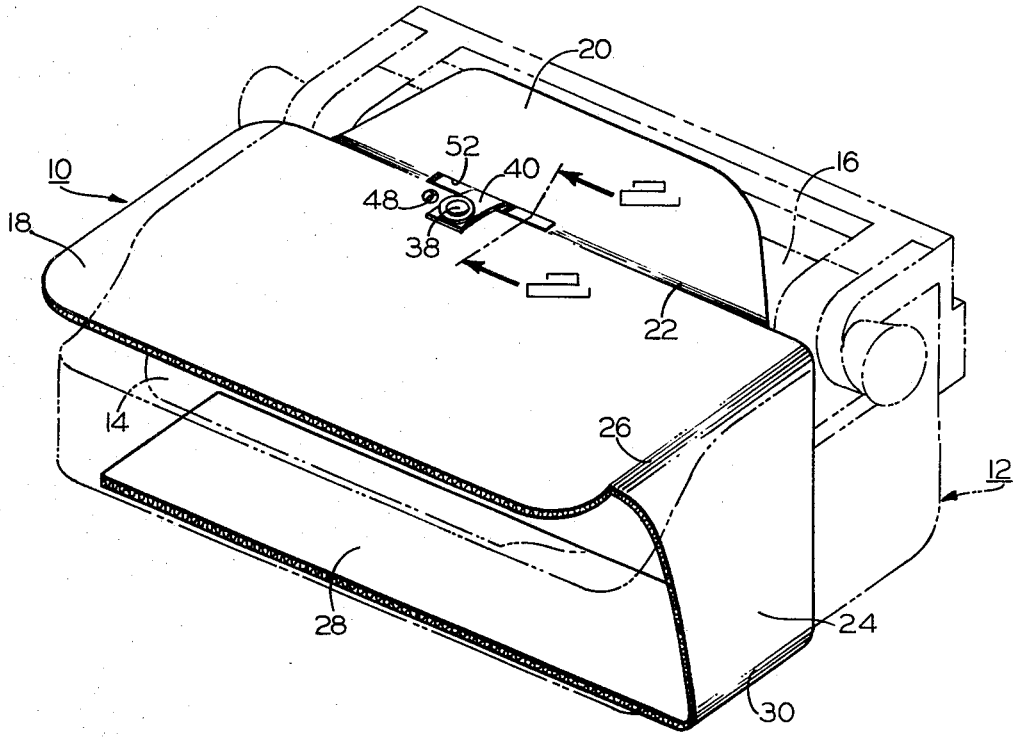
FIG. 1 is a perspective view of the invention shown in operative relationship to a typewriter shown in phantom.
Figure 2:
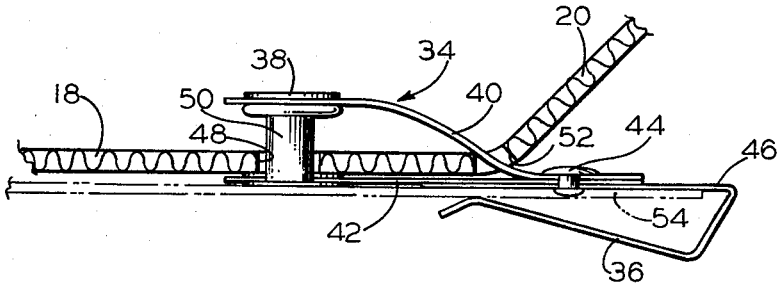
FIG. 2 is a detailed cross-sectional view of a snap and clip assembly used to secure the keyboard screen to the top of the typewriter.

To place the invention on a typewriter for use, it is first necessary to fold the shield 10 into the configuration generally indicated in FIG. 1. Then, the operator would raise the front portion of typewriter 12 and slide horizontal extension member 28 under at least one of the feet of the typewriter. Next, snap 38 is removed from post 50 and post 50 is inserted through one of the apertures 48 from the bottom in the sense of FIG. 1, while strap 40 and snap 38 are inserted through slot 52. Then snap 38 may be reattached to post 50. Clip 36 may then be slipped over casing 54. This is most easily accomplished while folding cylinder shield 20 forward and holding it down against typewriter shield 18.

In use, typewriter screen 18 obscures the keyboard from the view of the operator while cylinder screen 20 does the same with respect to the cylinder. Conveniently, however, the operator can easily check the position of his fingers and hands on the keyboard by merely raising his wrists against the underside of keyboard shield 18, thus raising it slightly. The flexibility of straps 40 and 42 permit this as does the overall flexibility of the cardboard or other material from which the shield 10 is fabricated. This feature is also made possible due to the fact that keyboard shield 18 is connected only on one side thus permitting it to raise quite readily at the left end in the sense of FIG. 1. Thus, although the shield could be made with an additional vertical extension member, like member 24, on both sides, the illustrated embodiment is believed to be preferable.

Similarly, when it becomes desirable for the student to check the typed copy, he merely needs to fold cylinder screen 20 towards the front of the typewriter, thereby exposing the copy to his view.

It will readily be appreciated that this invention has all of the advantages noted at the beginning of this specification. It is easily repairable with masking tape or another suitable material in the event that it should become torn or otherwise damaged. Most importantly, from a teaching point of view, it does not inhibit the operator's overall peripheral vision of the work area and it is silent in operation, thus providing no significant visual or audible distraction.

It is, of course, recognized that the invention would need to be modified for use with typewriters not having a casing 54 for convenient connection to clip 36. Many typewriters do, however, have such a casing and for these, the embodiment shown is believed to be the preferred form of the invention.

Those skilled in the art will understand that various modifications may be made to the invention without departing from its essence. It is intended to encompass such variations within the scope of the following appended claims.

What is claimed is:

1. A portable and compact shield for use with a typewriter supported by legs and having a keyboard, a cylinder and a casing comprised of:

a keyboard screen;

a cylinder screen hingedly connected to the keyboard screen;

vertical extension member hingedly connected to the keyboard screen on one side thereof and adapted to extend vertically downwardly from the keyboard screen along the side of the typewriter;

a lateral extension member hingedly connected to the vertical extension member, said lateral extension member being of sufficient length to extend under at least one of the legs of the typewriter; and means for flexibly and releasable fastening the keyboard screen to the casing of the typewriter, once the keyboard screen is released from the casing, the hinge between the keyboard screen and the vertical extension and the hinge between the vertical and lateral extensions being such as to permit the screens to be lifted away and folded off to the side of the typewriter for unobstructed access to the keyboard and cylinder.

2. The invention of claim 1 wherein the fastening means is comprised of a spring clip adapted to engage the casing and means for flexibly attaching the clip to the keyboard screen.

3. The invention of claim 2 wherein a slot is provided along a portion of the connection between the screens and at least one hole is provided in the keyboard screen relatively near the slot and wherein the attaching means is comprised of a snap adapted to engage the keyboard screen through the hole, said snap being attached to the clip by flexible strapping.

4. The invention of claim 1 or 2 wherein the screens and extension members are constructed of one continuous piece of cardboard and wherein the hinged connections are comprised of creases formed in the cardboard.

* * * * *